United States Patent [19]

Felthuis et al.

[11] Patent Number: 4,619,441

[45] Date of Patent: Oct. 28, 1986

[54] SHAFT FURNACE HAVING A METAL SHELL, A REFRACTORY LINING AND COOLING BODIES PROJECTING THROUGH THE SHELL INTO THE LINING

[75] Inventors: Jacob Felthuis, Oudorp; Jacobus Van Laar, Santpoort; Jacob Rengersen, Sint-Pancras, all of Netherlands

[73] Assignee: Hoogovens Groep B.V., IJmuiden, Netherlands

[21] Appl. No.: 595,682

[22] Filed: Apr. 2, 1984

[30] Foreign Application Priority Data

Apr. 1, 1983 [NL] Netherlands ..... 8301178

[51] Int. Cl.[4] ..... C21B 7/10

[52] U.S. Cl. ..... 266/193; 266/197

[58] Field of Search ..... 266/193, 194, 197, 280, 266/286, 190; 432/238, 233; 122/6 A, 6 B

[56] References Cited

U.S. PATENT DOCUMENTS

| | | | |
|---|---|---|---|
| 2,256,179 | 9/1941 | Thomson | 266/193 |
| 2,465,463 | 3/1949 | Lindemuth | 266/193 |
| 4,332,554 | 6/1982 | van Laar et al. | 266/194 |
| 4,335,870 | 6/1982 | Diener et al. | 122/6 B |
| 4,399,981 | 8/1983 | Nömtak | 266/283 |

FOREIGN PATENT DOCUMENTS

| | | | |
|---|---|---|---|
| 2023265 | 12/1979 | United Kingdom | 266/194 |

OTHER PUBLICATIONS

Geiger et al, "*Transport Phenomena in Metallurgy*", *pp. 189 & 196, Dec. 1980.*

*Primary Examiner*—L. Dewayne Rutledge
*Assistant Examiner*—S. Kastler
*Attorney, Agent, or Firm*—Stevens, Davis, Miller & Mosher

[57] ABSTRACT

In a shaft furnace having a metal shell, a refractory lining of relatively high thermal conductivity and cooling bodies which project inwardly through the shell into the lining and through which in operation cooling liquid flows, has a high uniformity of temperature in the lining. In order to improve its operational characteristics, in particular to improve temperature uniformity yet further while reducing heat loss, the shell and the cooling bodies are screened from the lining. Between the cooling bodies and the refractory lining and between the shell and the refractory lining there are respectively first and second thin layers of refractory material having in each case a λ-value of less than 5 kcal/mh °C., preferably less than 1.5 kcal/mh °C. The thin layers may be of refractory felt or refractory plates.

10 Claims, 1 Drawing Figure

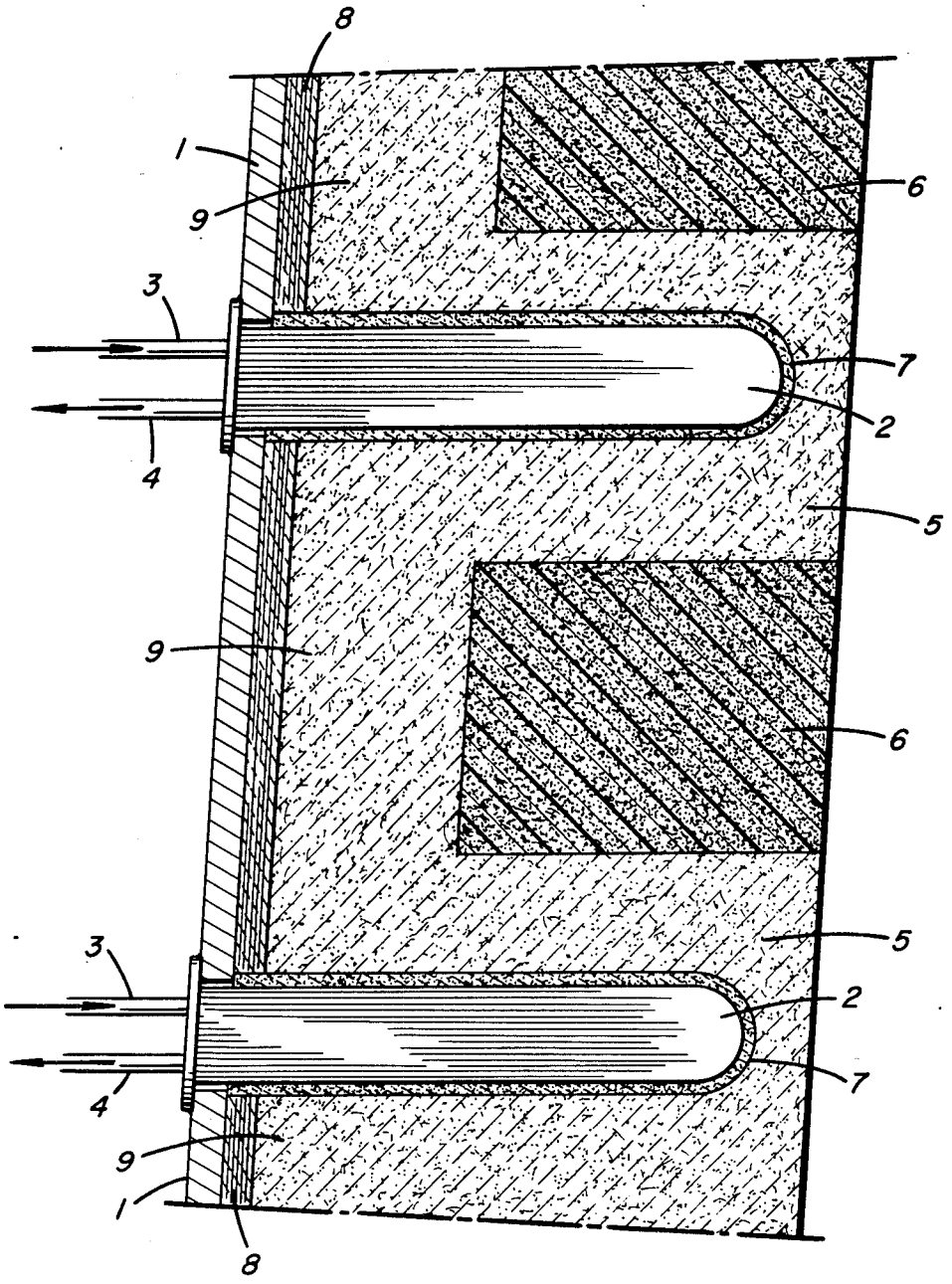
8
1
9
6
3
7
2
4
5
9
6
3
5
2
4
7
9
1
8

SHAFT FURNACE HAVING A METAL SHELL, A REFRACTORY LINING AND COOLING BODIES PROJECTING THROUGH THE SHELL INTO THE LINING

BACKGROUND OF THE INVENTION

1. Field of the Invention

This invention relates to a shaft furnace having a metal shell, a refractory lining and cooling bodies projecting through the shell into the lining, the cooling bodies being arranged for cooling liquid, e.g. water, to flow through them during operation of the furnace. The invention is especially applicable in a case where, at least adjacent each of the cooling bodies, the lining consists of a refractory material of coefficient of thermal conductivity (λ-value) of at least 10 kcal/mh°C. All λ-values are determined at 20° C.

2. Description of the Prior Art

Shaft furnaces, in particular blast furnaces, of the above type are known and can have the advantage of high uniformity of temperature in the lining. In U.S. Pat. No. 3,953,007 there is described for example a construction in which cooling plates which are located around the furnace in a horizontal plane are always in direct thermal contact with an annular graphite construction in the lining. This effects a uniform temperature distribution in the lining, in spite of the fact that the cooling plates transfer heat locally outside the lining. This uniformity of temperature distribution throughout the lining appears to be very favourable to the achievement of a long life of this lining.

Cooling bodies, e.g. plates, extending through the lining also function as anchors which help to prevent breaking away or shifting of the lining.

As remarked, the high coefficient of thermal conductivity of materials such as graphite and semi-graphite has advantages. More particularly, the use of graphite in lining constructions for shaft furnaces is also advantageous because of the high thermal shock resistance of this material. Among other things, this is associated with a much lower coefficient of thermal expansion and a higher strength at high temperatures than conventional refractory materials for blast furnace linings such as fire-brick. The construction described above initially can offer considerable advantages by virtue of its having a longer life than other lining constructions. The availability of the furnace is higher and the repair costs lower.

SUMMARY OF THE INVENTION

The object of the invention is to improve the operation of this type of shaft furnace, while retaining as far as possible the advantages mentioned above. The inventors herein have now realised that the operation of the furnace can be improved if heat loss from the furnace is substantially reduced.

According to the invention, between the cooling bodies and the refractory lining and between the shell and the refractory lining there are respectively first and second thin layers of refractory material having in each case a λ-value of less than 5 kcal/mh°C. These thin layers screen the metal shell and the cooling bodies from the lining and so reduce heat flow out of the lining.

By the provision of these thin layers, the function of the cooling bodies as anchors for the lining is not affected. The overall temperature level in the lining will rise a little with, however, a significant lowering of the amount of heat which is lost via the cooling liquid and/or the shell. The lower rate of heat transport via the cooling elements also results in an even better uniformity of temperature distribution in the lining. Although the mean temperature of the lining increases a little, yet the particular temperature differences which give rise to thermal stresses in the refractory material are lower. It has appeared that modern high-quality refractory materials such as graphite, semi-graphite, silicon carbide and high alumina fire-brick (chamotte) are in a large measure resistant to the higher temperatures which can occur on the furnace side of the refractory material in the furnace of the invention.

Preferably the materials of the first and second thin layers have a λ-value of less than 1.5 and more preferably less than 0.5 kcal/mh°C. Preferred thickness for the first layer is between 2 and 10 mm and for the second layer between 5 and 30 mm. From the constructional point of view, good results can be obtained if the thin layers, especially the first layer around the cooling bodies, consist at least partly of refractory felt material e.g. materials commercially available. Good results are also obtainable especially for the second thin layer located against the steel shell by use of plates of refractory insulation material.

Refractory felt material which is in common use consists of $Al_2O_3/SiO_2$ composites.

The usual type of refractory insulating material in plate form consists for instance of 20 mm or 25 mm thick plates of, for instance, calcium silicate, aluminium silicate or calcium/aluminium silicate. These plates are made from furnace slag.

The choice of the materials to be used for the lining is also dependent among other things on the thermal load of a particular wall section of the shaft furnace. At the thermally most heavily loaded wall sections, such as for instance the bosh of a blast furnace, it is preferable that adjacent the cooling bodies and the shell the lining consists of graphite and that the intervening spaces i.e. locations spaced from the shell and the cooling bodies is filled with either semi-graphite or graphite. However, particularly in regions which are subject to a heavy mechanical load from the shearing action of the furnace charge the use of silicon carbide at locations away from the shell and the cooling bodies may be very advantageous, or the whole lining may consist of silicon carbide with the exception of the thin insulating layers with a λ-value of less than 5 kcal/mh°C. Silicon carbide has a coefficient of thermal conductivity (λ) of about 10–30, compared with that of graphite which is 60–100 kcal/mh°C.

Since the cooling bodies serve as anchors for the lining, an expansion tolerance is often built in in the construction of the lining, so that when the furnace is fired it is possible to avoid extreme expansion forces. If because of the application of the invention the temperature level in the lining is shifted somewhat higher, it is naturally necessary to allow for this in the calculation of the expansion possibility.

BRIEF INTRODUCTION OF THE DRAWINGS

A preferred embodiment of the invention will now be described by way of non-limitative example with reference to the accompanying drawing in which the single FIGURE is a schematic vertical sectional view of a portion of the wall of a furnace embodying the invention.

DESCRIPTION OF THE PREFERRED EMBODIMENT

The drawing shows a steel jacket or shell 1 forming the exterior of the furnace.

At regular spacings over the height and circumference of the shell 1 there are cooling bodies in the form of plates 2 which are bolted or welded to the shell 1 through which they project into the refractory lining to be described. Each cooling plate 2 has connections 3 and 4 for supply and discharge of cooling liquid. The cooling plates 2 are, embedded in the surrounding refractory structures 5, consisting of graphite, which are mutually connected by refractory wall sections 9, also consisting of graphite and located against the steel shell 1. The spaces thus left by the graphite are filled with silicon carbide or semi-graphite lining portions 6. For extremely heavily thermally loaded wall sections the parts 6 can also consist of graphite.

The cooling plates 2 are wrapped in a 3 mm thick layer 7, consisting of refractory felt. This refractory felt consists chiefly of an $Al_2O_3/SiO_2$ composite, and is commercially obtainable. Its λ-value is 0.2 to 0.3 kcal/mh°C.

Between the parts 5 and 9 and the steel shell 1 there is a thermally insulating layer 8 with a thickness of 20 mm. This layer consists of plates of refractory insulating material which is calcium silicate, aluminium silicate or calcium/aluminium silicate with a λ-value of 0.2 to 0.3 kcal/mh°C.

In a furnace as illustrated but without the thin insulating layers 7 and 8 there is during normal operation a heat flow of on average 50,000 kcal/$m^2$h measured via the cooling water and as heat loss through the steel shell 1. It appears from calculations that by the application of the insulating layers 7 and 8 this heat flow may be reduced by about 50%.

In a blast furnace, heat removed via a wall must be supplied to the furnace in the form of fuel (coke, oil, pulverised coal or hot combustion air). By reducing the heat loss in the wall in the manner described it is possible to make a saving in the fuel supplied, and this not only means a saving in fuel but also makes it possible for an increase in the ore charge of the blast furnace and thus in the production rate of reduced iron.

Only one embodiment has been described, to exemplify the invention, but the invention is not restricted to this embodiment but embraces all constructions within the scope and spirit of the following claims.

What is claimed is:

1. A shaft furnace having a metal shell, a refractory lining on the interior side of the shell and cooling bodies which project inwardly through the shell into the lining and through which in operation cooling liquid flows, the lining, at least adjacent each of the cooling bodies, consisting of a refractory material with a coefficient of thermal conductivity (λ-value) of at least 10 kcal/mh°C. determined at 20° C. there further being provided, between the cooling bodies and the refractory lining a first thin layer of refractory material in contact with the bodies and the refractory lining and between the shell and the refractory lining a second thin layer of refractory material in contact with the shell and the refractory lining, said thin layers of refractory material having in each case a λ-value of less than 5 kcal/mh°C. determined at 20° C.

2. A shaft furnace according to claim 1 wherein each of said first and second layers has a λ-value of less than 1.5 kcal/mh°C.

3. A shaft furnace according to claim 2 wherein each of said first and second layers has a λ-value of less than 0.5 kcal/mh°C.

4. A shaft furnace according to claim 1 wherein the said first layer has a thickness in the range 2 to 10 mm.

5. A shaft furnace according to claim 4 wherein the second layer has a thickness in the range 5 to 30 mm.

6. A shaft furnace according to any one of claims 1,2 and 4 wherein at least one of the first and second layers consists at least partly of a refractory felt material.

7. A shaft furnace according to any one of claims 1, 2 and 4 wherein at least one of the first and second layers consists at least partly of plates of refractory material.

8. A shaft furnace according to any one of claims 1, 2 and 4 wherein the first layer consists of refractory felt and the second layer consists of plates of insulating material.

9. A shaft furnace according to any one of claims 1, 2 and 4 wherein, at least at the region of highest thermal loading of the furnace wall, the refractory lining is of graphite adjacent the shell and the cooling bodies and is of semi-graphite, silicon carbide or graphite at locations spaced from the shell and the cooling bodies.

10. A shaft furnace according to any one of claims 1, 2 and 4 wherein substantially the whole of the refractory lining, apart from the first and second layers, is of silicon carbide.

* * * * *